US009375088B2

(12) United States Patent
Andoloro

(10) Patent No.: US 9,375,088 B2
(45) Date of Patent: Jun. 28, 2016

(54) APPARATUS FOR SUPPORT DURING TATTOOING

(71) Applicant: InkBed, Inc., Everett, WA (US)

(72) Inventor: Cosmo J. Andoloro, Puyallup, WA (US)

(73) Assignee: InkBed, Inc., Everett, WA (US)

( * ) Notice: Subject to any disclaimer, the term of this patent is extended or adjusted under 35 U.S.C. 154(b) by 0 days.

(21) Appl. No.: 14/164,035

(22) Filed: Jan. 24, 2014

(65) Prior Publication Data

US 2014/0167456 A1 Jun. 19, 2014

Related U.S. Application Data

(63) Continuation of application No. 12/876,953, filed on Sep. 7, 2010, now Pat. No. 8,651,569.

(51) Int. Cl.

| | |
|---|---|
| ***A47C 7/50*** | (2006.01) |
| ***A47C 1/024*** | (2006.01) |
| ***A47C 1/026*** | (2006.01) |
| ***A47C 1/03*** | (2006.01) |
| ***A47C 1/034*** | (2006.01) |
| ***A47C 3/18*** | (2006.01) |

(52) U.S. Cl.

CPC ..... *A47C 1/024* (2013.01); *A47C 1/026* (2013.01); *A47C 1/03* (2013.01); *A47C 1/0342* (2013.01); *A47C 3/18* (2013.01); *A47C 7/503* (2013.01); *A47C 7/506* (2013.01)

(58) Field of Classification Search

CPC ..... A47C 1/022; A47C 1/06; A47C 7/50; A47C 7/503; A47C 7/506; A47C 1/026; A47C 1/03; A47C 1/0342; A47C 3/18

See application file for complete search history.

(56) References Cited

U.S. PATENT DOCUMENTS

| | | | | |
|---|---|---|---|---|
| 3,145,053 | A | | 8/1964 | Thompson et al. |
| 3,188,136 | A | * | 6/1965 | Redfield et al. ..... 297/71 |
| 3,227,440 | A | | 1/1966 | Scott |
| 4,170,800 | A | | 10/1979 | Wiberg |
| 4,285,541 | A | | 8/1981 | Onishi |
| 4,387,888 | A | | 6/1983 | Marinakis |
| 4,516,805 | A | | 5/1985 | Leeper et al. |
| 4,650,249 | A | | 3/1987 | Serber |
| 4,660,549 | A | | 4/1987 | Kowalski et al. |
| 4,795,214 | A | | 1/1989 | Holdt |
| 5,060,327 | A | | 10/1991 | Celestina et al. |
| 5,086,769 | A | | 2/1992 | Vianello et al. |

(Continued)

FOREIGN PATENT DOCUMENTS

| | | | |
|---|---|---|---|
| CN | 2151738 | Y | 1/1994 |
| CN | 201119969 | Y | 9/2008 |

(Continued)

OTHER PUBLICATIONS

"Hydraulic All Purpose Tattoo Chair KI New York", http://www.puretat.com, accessed Jan. 18, 2010, 2 pages.

(Continued)

*Primary Examiner* — Philip Gabler
(74) *Attorney, Agent, or Firm* — Perkins Coie LLP

(57) ABSTRACT

An apparatus that supports a person in a variety of positions so that a tattoo artist can comfortably apply a tattoo to the skin of the supported person is herein disclosed. The apparatus can be articulated to cause a person's legs and arms to be optimally positioned and supported to receive a tattoo.

23 Claims, 18 Drawing Sheets

(56) References Cited

U.S. PATENT DOCUMENTS

| | | | | |
|---|---|---|---|---|
| 5,098,158 | A | 3/1992 | Palarski | |
| 5,315,722 | A | 5/1994 | Djie | |
| 5,401,078 | A | 3/1995 | Riach | |
| 5,487,590 | A | 1/1996 | Haynes | |
| 5,642,542 | A | 7/1997 | Kometani | |
| 5,645,313 | A | 7/1997 | Best et al. | |
| 5,653,499 | A * | 8/1997 | Goodall | 297/170 |
| 5,678,894 | A | 10/1997 | Eley | |
| 5,762,402 | A | 6/1998 | Gillotti | |
| 5,967,610 | A | 10/1999 | Lin | |
| 5,971,475 | A | 10/1999 | Lawson et al. | |
| 5,971,485 | A | 10/1999 | Clark | |
| 6,089,593 | A | 7/2000 | Hanson et al. | |
| 6,135,548 | A | 10/2000 | McGuire | |
| 6,212,713 | B1 | 4/2001 | Kuck et al. | |
| 6,315,319 | B1 | 11/2001 | Hanson et al. | |
| 6,446,287 | B2 * | 9/2002 | Borders | 5/618 |
| 6,619,747 | B2 | 9/2003 | Ko et al. | |
| 6,767,066 | B1 | 7/2004 | Tornero | |
| 6,824,219 | B2 | 11/2004 | Ruckstadter | |
| 6,846,042 | B2 | 1/2005 | Hanson et al. | |
| 6,918,143 | B2 | 7/2005 | Wiberg | |
| 7,021,037 | B1 | 4/2006 | Szymas | |
| 7,080,885 | B2 | 7/2006 | Bain et al. | |
| 7,234,768 | B2 | 6/2007 | Manning et al. | |
| 7,293,834 | B2 | 11/2007 | Riach et al. | |
| 7,600,817 | B2 | 10/2009 | Kramer et al. | |
| 7,784,871 | B2 | 8/2010 | Cochran et al. | |
| 1,027,297 | A1 | 11/2011 | Wei et al. | |
| 8,651,569 | B2 | 2/2014 | Andoloro et al. | |
| 2002/0000008 | A1 | 1/2002 | Borders | |
| 2002/0067060 | A1 | 6/2002 | Lloyd | |
| 2004/0133979 | A1 | 7/2004 | Newkirk et al. | |
| 2006/0225212 | A1 | 10/2006 | Parson et al. | |
| 2007/0052275 | A1 | 3/2007 | Ghilzai | |
| 2009/0250565 | A1 | 10/2009 | Jaggers et al. | |
| 2010/0295357 | A1 | 11/2010 | Koehler et al. | |
| 2011/0272976 | A1 | 11/2011 | Wei et al. | |

FOREIGN PATENT DOCUMENTS

| | | | |
|---|---|---|---|
| WO | WO-2009056004 | A1 | 5/2009 |
| WO | 2013078569 | A1 | 6/2013 |

OTHER PUBLICATIONS

"Traveler—The Ultimate Table", http://www.tattootable.com, Fab Tech, accessed Jan. 18, 2010, 3 pages.

"Tattoo-Chairs-table", http://www.tattoochair.com, © 2009, accessed Jan. 18, 2010, 7 pages.

"Tatsoul 370" http://www.tatsoul.com, accessed Feb. 2, 2010, 7 pages.

International Searching Authority, International Search Report and Written Opinion, counterpart PCT Patent Application PCT/US2015/010910, mailed May 11, 2015, 14, pages.

* cited by examiner

APPARATUS FOR SUPPORT DURING TATTOOING

CROSS-REFERENCE TO RELATED APPLICATION

This application is a continuation application of U.S. patent application Ser. No. 12/876,953, filed on Sep. 7, 2010, and entitled "APPARATUS FOR SUPPORT DURING TATTOOING," which is hereby incorporated herein in its entirety by reference.

BACKGROUND

During the first decade of the 21st century, the popularity of tattoos have exploded, inspiring growth and refinement in the equipment used to create tattoos and the sophistication of the tattoos themselves. In order to meet the current needs of clients, a typical tattoo studio needs to have a variety of tools to apply tattoos to clients. For example, a tattoo artist may have a tattoo chair, table, arm stand, foot rest, etc. All of these pieces of furniture take up space, yet are required in order to properly apply tattoos.

For the most part, the furniture used by tattoo artists is not specifically designed to be used to apply tattoos, but rather, are used for other applications, such as in medical or beauty salon applications. Thus, prolonged use of the furniture in tattooing may be uncomfortable for both the tattoo artist and the client. For example, many tattoo artists use massage tables to apply tattoos to a client's back, shoulders, legs, etc. These tables were not designed with the ergonomics of a tattoo artist in mind and may not be comfortable or healthy.

Moreover, commonly used furniture in tattooing may not be able to place the client in a position that naturally stretches the skin of the area that is going to receive the tattoo. In order to apply a professional looking tattoo, the skin needs to be stretched or else otherwise, the tattoo may be applied incorrectly, i.e., the tattoo may be disfigured. In order to compensate for this, a tattoo artist typically has to stretch the skin by hand and hold it in position while the tattoo is applied. This is uncomfortable for the tattoo artist and the client. Plus, the artist may not stretch the skin in a way that it would naturally stretch.

Accordingly, there is a need in the art for an apparatus that can be used to position a client in optimal positions in order to apply tattoos on any part of the body while simultaneously being comfortable for the client and the artist. Moreover, there is a need in the art to reduce the number of different pieces of furniture that an artist needs to own in order to apply tattoos.

SUMMARY

An exemplary embodiment describes an, apparatus for supporting a person during tattooing. The apparatus can be configured such that a client can be placed in an ergonomic position, i.e., a position that is comfortable for the both the client and the tattoo artist. For example, the apparatus can be configured from a bed position, i.e., a horizontal position, into a chair position, i.e., a position where certain sections of the apparatus are articulated relative to the floor.

In at least one exemplary embodiment, the apparatus can include arm sections, leg sections, a seat section, and a back section, some of which can be coupled to a frame. Each section can be made to comfortably support and articulate different parts of a client's body during a tattoo session. For example, the arm sections can be raised, lowered, or angled in order to place the arms of a client in positions to comfortably support the arms while one or more tattoos are applied.

The leg sections can be attached such that each leg is independently rotatable in a direction perpendicular from a plane formed by the seat section. Or put another way, each leg section can be independently rotatable about an axis parallel to a frontal plane and a transverse plane. For example, the leg sections can be rotated up to 90 degrees downward from a plane formed by the seat section from a bed configuration to a chair configuration. In the same, or another embodiment, each leg section can also be rotated up to, for example, 90 degrees outward from the midsagittal line of the seat section to allow a tattoo artist access to the inner leg and/or lower back portions of a client.

In the same, or another embodiment, the back section can be attached such that it is independently rotatable in a direction that is perpendicular from a plane formed by the seat section. A client can sit with his or her back resting against the back section of the apparatus.

In another configuration, the back section can be formed to include cuts defining leg openings. In this exemplary embodiment, and when the back section is articulated such that it is generally perpendicular to a plane formed by the seat section, the cuts can be formed such that the proximal end of the back section, e.g., the end closest to the seat section, is narrower in the frontal plane than the distal end of the seat section. In an exemplary embodiment, the cuts can be formed such that the back section looks like a cobra's hood.

A client can sit with his or her back or chest resting against the back section of the apparatus. When a client sits with his or her chest resting against the back section of the apparatus, the client can straddle the proximal portion of back section by placing his or her legs through the cuts defining leg openings.

In an exemplary embodiment, the seat section can include two rearwardly extending leg supporting segments that encircle the proximal portion of the back section. In this embodiment, the rearwardly extending leg supporting segments can support the thighs of a client while he or she is straddling the back section. In this exemplary embodiment, when the apparatus is in the bed configuration the rearwardly extending leg supporting segments can form, along with the cuts defining leg openings, a generally flat surface for a client to lie on.

The foregoing is a summary and thus contains, by necessity, simplifications, generalizations and omissions of detail. Those skilled in the art will appreciate that the summary is illustrative only and is not intended to be in any way limiting.

DETAILED DESCRIPTION

Figure 1:
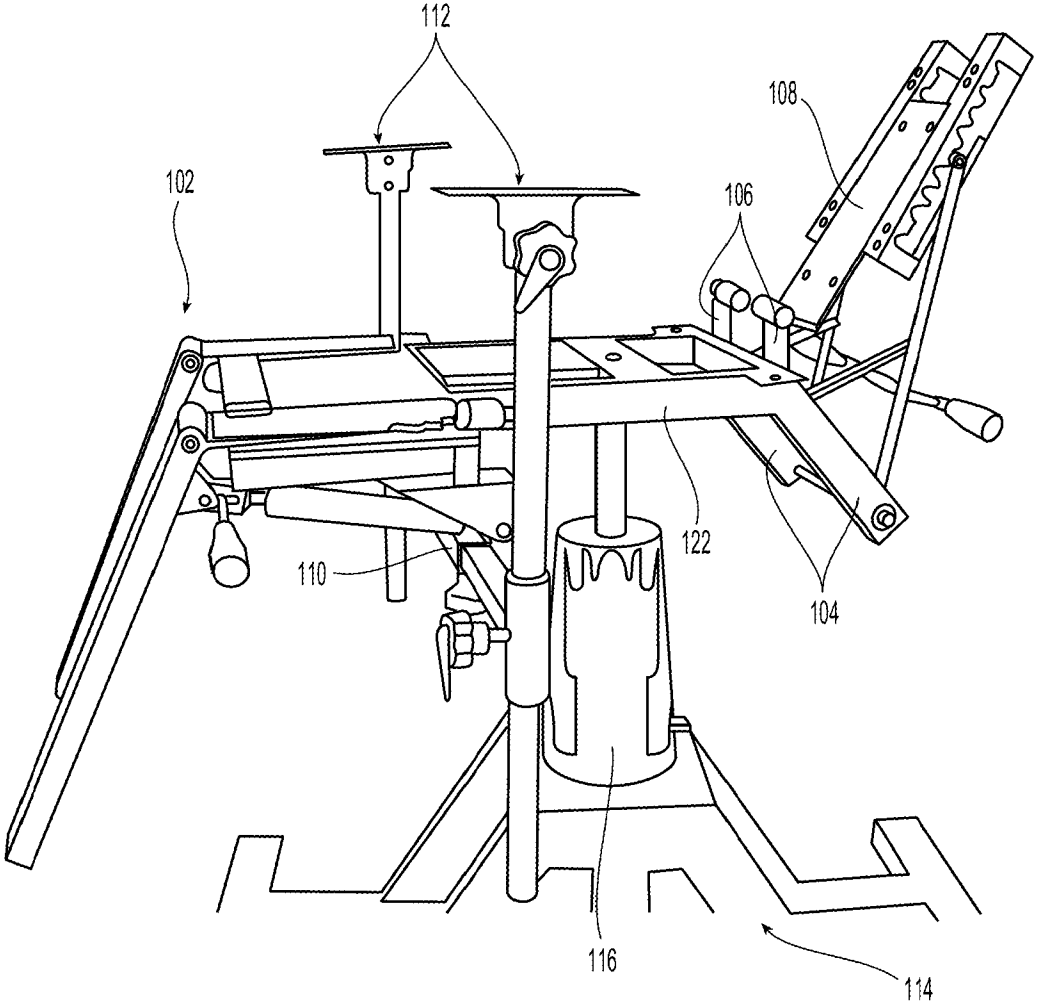
FIG. 1 illustrates a side illustration of an exemplary apparatus' frame.

Turning now to FIG. 1, an exemplary frame 122 is illustrated. In an embodiment, exemplary frame 122 can include a generally flat portion that is parallel to the ground, which is also known as the transverse plane, i.e., the plane that divides the apparatus into top and bottom sections. As shown by the figure, and described in more detail below, a front portion of frame 122 can be "T" shaped to support leg assemblies 102 configured to independently rotate away from a position generally parallel to the midsagittal plane, i.e., a plane passing through the middle of the apparatus dividing it into left and right portions, to positions generally perpendicular to the midsagittal plane.

The front portion of frame 122 can be separated from a back portion by the frontal plane, i.e., a plane that divides the apparatus into front and back portions. In an exemplary embodiment, back portion of frame 122 can be formed to include one or more rear downward angled support members 104 and upwardly extending support sections 106 that are configured to connect to an L-hinge 108, which can be coupled to a back section. As will be described in more detail below, the back section can be articulated.

In the illustrated exemplary embodiment, a horizontal tubular rail 110 such as, for example, a steel rectangular or circular tube, can be coupled to the bottom of frame 122 extending in a direction parallel to the transverse and frontal planes. The horizontal tubular rail 110 can be used to attach arm bar assemblies 112. In at least one exemplary embodiment, the arm assemblies can be articulated such that each assembly can be independently linearly moved in a direction that is perpendicular to the midsagittal plane. In an exemplary embodiment, and described in more detail in the following paragraphs, the arm assemblies can also be articulated such that the arm supports are articulated about an axis parallel to the transverse plane and the midsagittal plane.

Also shown by the figure, a chassis 114 is coupled to the bottom of frame 122. Frame 122 can rotate about chassis 114 such that it rotates about, for example, the vertical axis, i.e., an axis parallel to the midsagittal plane and the frontal plane. In at least one exemplary embodiment, chassis 114 can be coupled to a hydraulics assembly, which can be used to raise and lower frame 122. That is, frame 122 can be linearly moved through the transverse plane in an exemplary embodiment.

Figure 2:
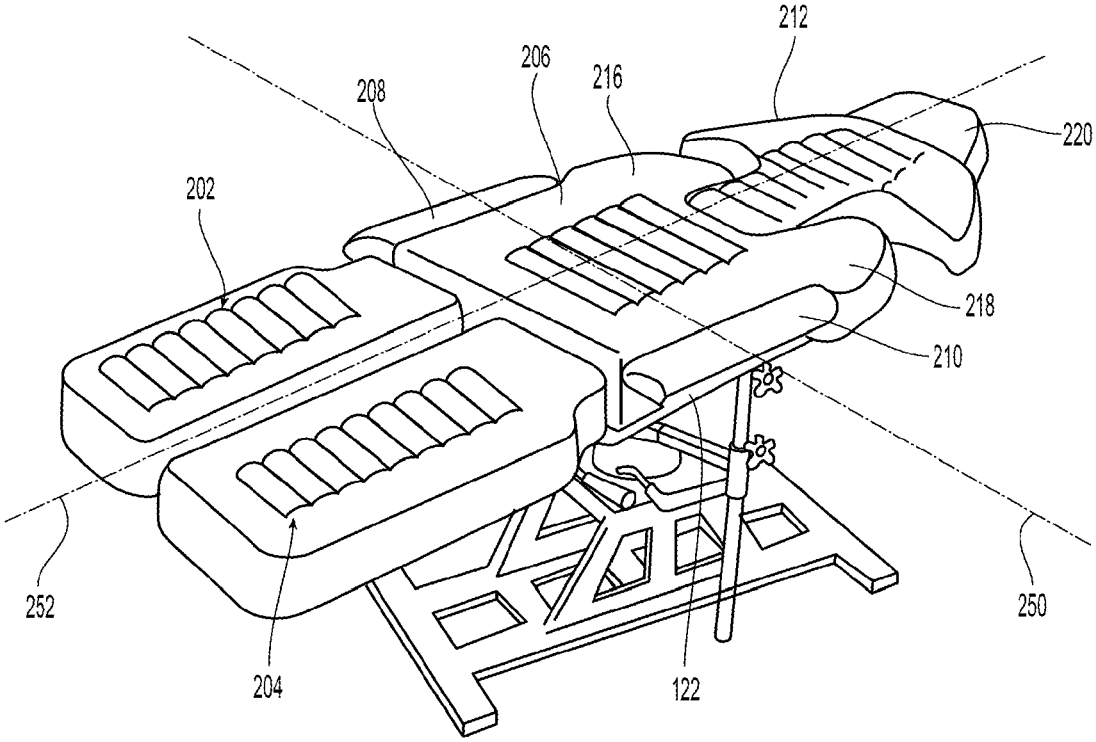
FIG. 2 illustrates a quarter view of an exemplary apparatus in a bed configuration.

Turning now to FIG. 2, it illustrates the exemplary apparatus in the bed configuration. That is, leg sections 202 and 204, arm sections 208 and 210, seat section 206, back section 212, and head rest 220 are flush with seat section 206, together forming a generally flat surface for a client to lie on. In this exemplary embodiment, frame 122 is generally covered with these supporting sections. This figure more clearly illustrates an axis parallel to both the midsagittal plane and the transverse plane 252. This axis is formed by the midsagittal plane cutting through the apparatus and separates the right from left side. Also shown is an axis parallel to both the frontal plane and the transverse plane 250. This axis is formed by the frontal plane cutting through the apparatus and separates the front from the back.

Briefly, seat section 206 can include top and bottom portions separated by a plane parallel to the transverse plane, forward and rearward portions separated by a plane parallel to the frontal plane, and left and right portions separated by a plane parallel to the midsagittal plane. Seat section 206 can include a bacteria resistant fabric cushion filled with foam padding or the like. The bottom of seat section 206 can be operatively coupled to frame 122 via one or more bolts, screws, pins, buttons, nails, an adhesive, etc.

Back section 212 is also shown. Back section 212 can also include a bacteria resistant fabric cushion filled with foam padding or the like. As is described in more detail below, back section 212 can be operatively coupled via one or more bolts, screws, pins, buttons, nails, an adhesive, etc., to a hinge. In an exemplary embodiment, the hinge can be L-shaped. In another exemplary embodiment, back section 212 can be coupled to seat section 206 via a hinge.

In exemplary embodiments, back section 212 can be formed into a variety of shapes in order to support a client's back in the bed and chair configurations, and allow for a user to straddle it. In this exemplary embodiment, the proximal portion of the back section 212 can be narrower than the distal portion in order to define leg openings. The leg openings can be formed by removing different types of shapes from of back section 212, such as, for example, plano-concave cuts, incurvation-shaped cuts, generally rectangular, generally circular, generally oval, or generally square cuts, or cuts defined by a tapering from the proximal end of the back section to the distal end. In at least one exemplary embodiment, the back section could be generally "T" or "Y" shaped.

As stated briefly above, back section 212 can be rotatably coupled to, for example, the rear portion of seat section 206 or a hinge coupled to frame 122. One exemplary coupling is described in more detail in FIGS. 4 and 5. The coupling that attaches the proximal portion of back section 212 can be used to reconfigure apparatus 100 from a bed position (shown in FIG. 2) to a chair position (shown in FIG. 6). For example, a user could rotate back section 212 from the position illustrated in FIG. 2 to the position illustrated in FIG. 6 by rotating back section 212 from a position whereby back section 212 is flush with seat section 206, i.e., parallel to the traverse plane, to a position whereby back section 212 is generally perpendicular to seat section 206, i.e., generally parallel to the frontal plane.

Turning to leg sections 202 and 204, these sections can also be formed from bacteria resistant fabric cushions filled with foam padding or the like. As described in more detail below, leg sections 202 and 204 can be operatively coupled to the forward portion of seat section 206 or coupled to frame 122. In an exemplary embodiment, leg sections 202 and 204 can be coupled to rotatable assemblies that can independently rotate the leg sections about an axis parallel to the transverse and frontal planes. Or put another way, legs 202 and 204 can independently rotate from a position generally flush with seat section 206, e.g., the position shown in FIG. 2, to a position generally perpendicular to a plane formed by the seat section 206, e.g., similar to the position shown in FIG. 6.

Figure 13:
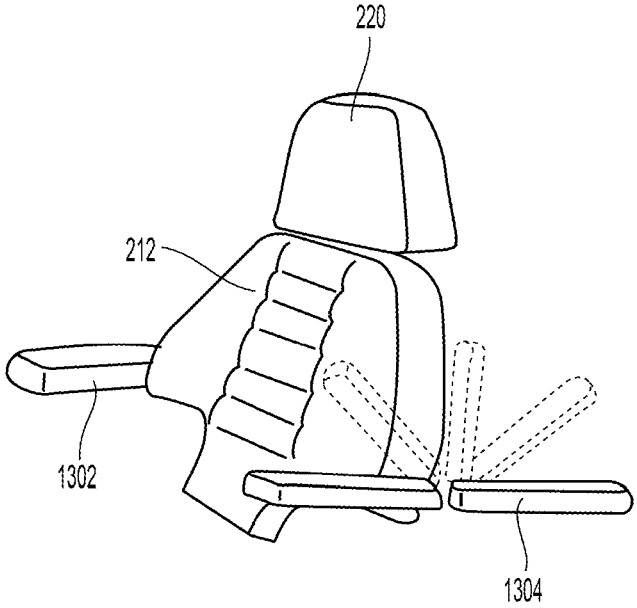
FIG. 13 illustrates a side view of an exemplary back section including exemplary arm frame supports rotatably coupled to the back section.
Figure 14:
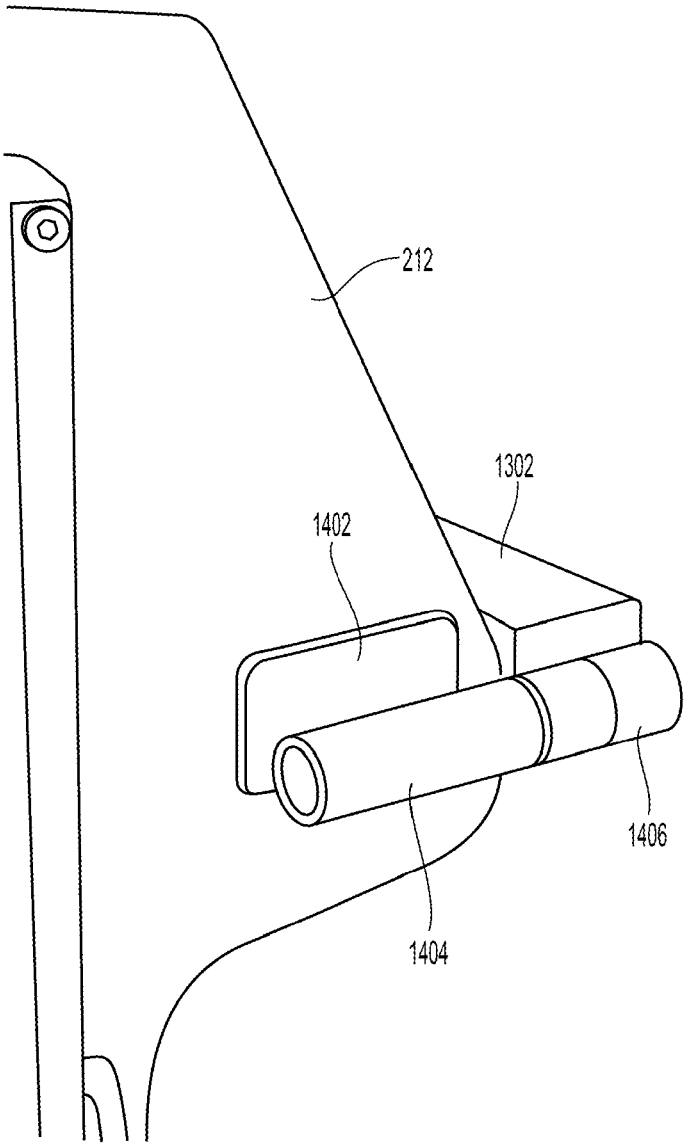
FIG. 14 illustrates a view from behind an exemplary back section.

In at least one embodiment, leg sections 202 and 204 can also be rotated about an axis parallel to the frontal and midsagittal planes. Or put another way, in an exemplary embodiment, each leg 202 and 204 can be independently rotated from the position shown in FIG. 6 to the position shown in FIG. 15. One exemplary rotatable coupling is shown by FIGS. 13 and 14; however, other couplings can be used.

Continuing with the description of FIG. 2, the cuts that define the leg openings are shown as generally adjoined with rearwardly extending leg supports 216 and 218. In an exemplary embodiment, the rearwardly extending leg supports can have a shape similar to the shape cut out of back section 212. For example, if the cuts are square-like, rearwardly extending leg supports can be formed to be square-like. If the cuts are plano-concave shaped, rearwardly extending leg supports can formed to be plano-convex shaped. As shown by the figure, the rearwardly extending leg supports do not need completely fill the area made by the cuts that define the leg openings. Instead, rearwardly extending leg supports may only fill enough of the openings so that a client can lie flat on the apparatus in the bed configuration.

Figure 3:
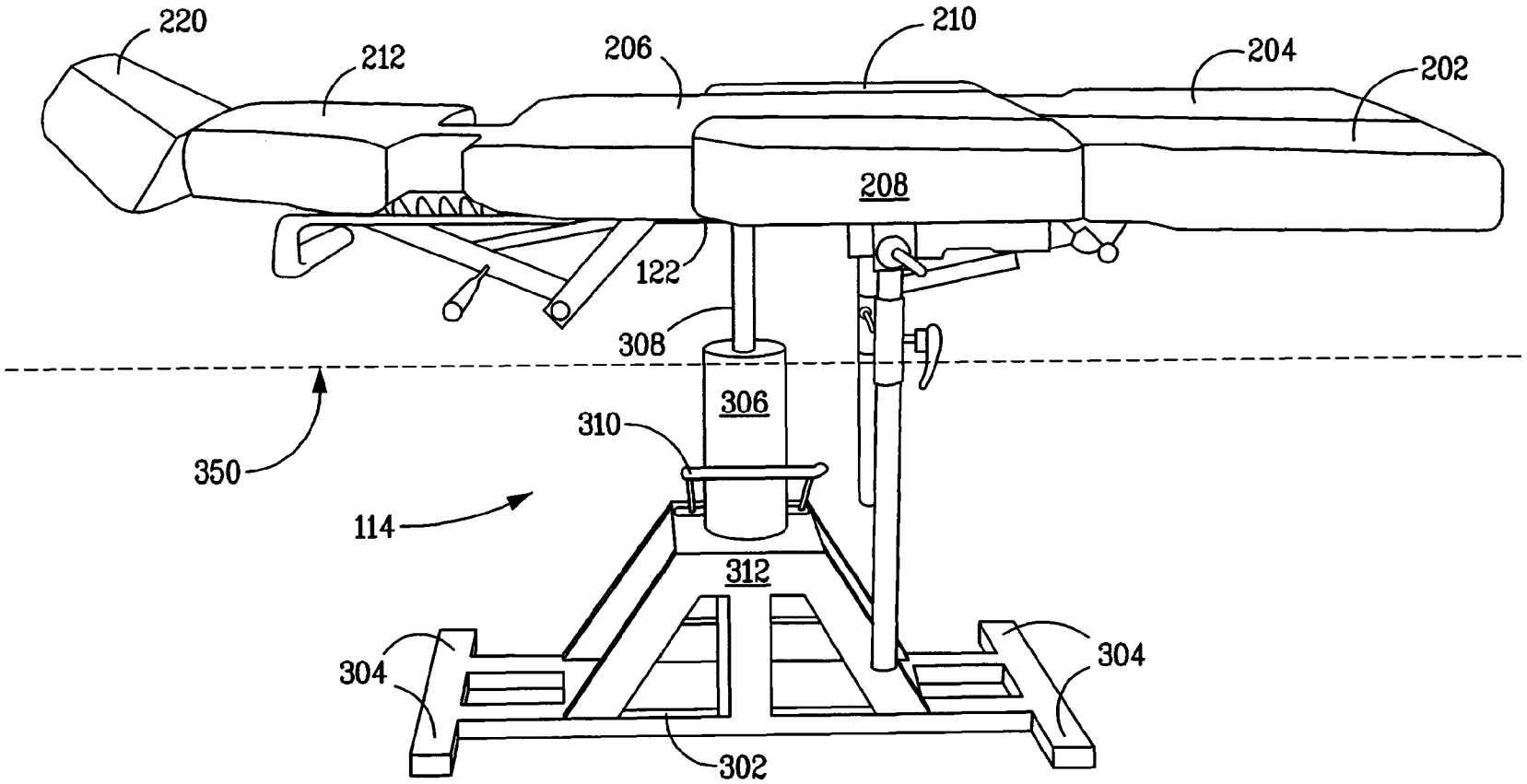
FIG. 3 illustrates a side view of an exemplary apparatus in a bed configuration.

Turning now to FIG. 3, it illustrates a side view of the exemplary apparatus illustrating an exemplary chassis 114. This view illustrates more clearly an axis 350 that is parallel to both the transverse plane and the frontal plane. The exemplary axis 350 separates the apparatus into top and bottom sections. As shown by the figure, in an exemplary embodiment, chassis 114 can include a support plate 302 that can lie on the floor. In this embodiment, chassis 114 can be bolted to floor, for example. Support plate 302 can be made from any suitable material such as wood or steel. As illustrated by the figure, in at least one embodiment, support plate 302 can be constructed to increase stability and to aid in the process of applying a tattoo. For example, and as illustrated by the figure, support plate 302 can be formed with stabilizer plate sections 304 that extend in the transverse plane, perpendicular to the midsagittal plane, from the ends of support plate 302 to allow chassis 114 to support a wider or longer load. For example, the stabilizer plate sections 304 can help prevent the apparatus from flipping over when the apparatus is rotated about an axis parallel to the midsagittal plane and the frontal plane. The illustrated configuration of support plate 302 can aid in the process of applying a tattoo because the tattoo artist can maneuver a chair closer to the apparatus than he or she would be able to if the support plate was wider. This configuration allows for a tattoo artist to sit in a more comfortable position while he or she is working.

Continuing with the description of the figure, chassis 114 can include a frustum section 312 coupled to support plate 302. As shown by the figure, frustum section 312 can be configured to provide clearance for the arm assemblies as they rotate about the axis parallel to the midsagittal plane and the frontal plane when seat section 206 is rotated. A hydraulics system 306 can be attached to an upper portion of frustum section 312. Release lever 310 can be used to lower and raise shaft 308. In an exemplary embodiment, the top of seat section 206 can be approximately 29 inches off the ground when the hydraulic system 206 is at its lowest position. When hydraulics system 206 is engaged, it can raise shaft 308 approximately 7 more inches to 36 inches. Thus, in exemplary embodiments, the height of apparatus 100 may be adjusted to allow for the tattoo artist to orient a client in an ergonomically correct position. As one of skill in the art can appreciate, these exemplary values are for illustration purposes only and can be adjusted based on the height hydraulics system 306 can raise the apparatus, the height of frustum section 312, the materials used to construct the apparatus, the length of the apparatus in the bed configuration, and the width of the apparatus.

Figure 4:
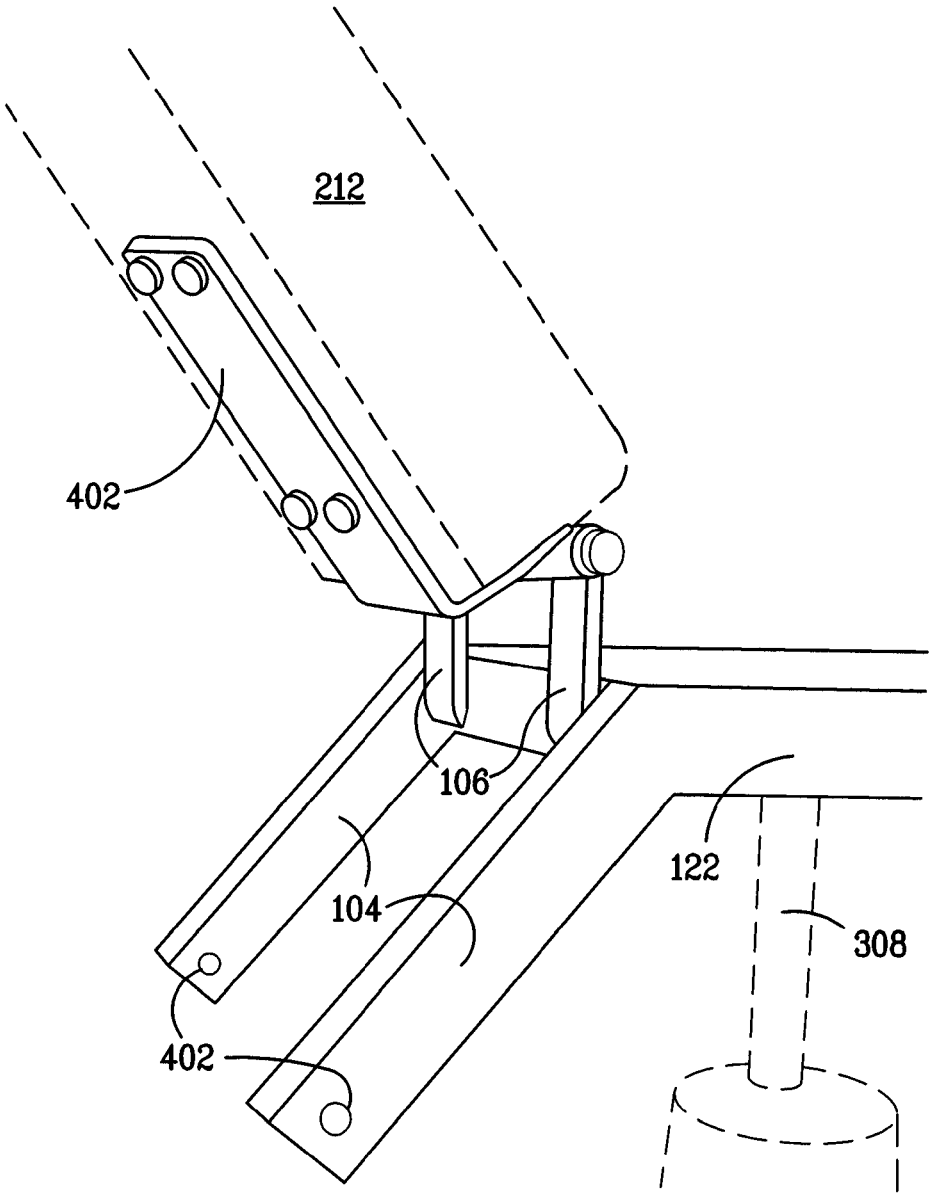
FIG. 4 illustrates a side view of a back portion of an exemplary frame of an apparatus.

FIG. 4 illustrates a view of the rear portion of frame 122 without seat section 206 attached. Back section 212 and hydraulics system 306 are illustrated in dashed lines so that the rear portion of frame 122 can be easily illustrated. In an exemplary embodiment, the back portion of back section 212 can be attached to an L-shaped hinge 402 via one or more bolts or pins.

In another alternative embodiment, a generally flat plate connected to a hinge can be used instead of L-shaped hinge 402. In this exemplary embodiment, the length of upwardly extending plates 106 and/or the thickness of seat section 206 can be adjusted such that when back section 212 is in the bed configuration the back section 212 is flush with seat section 206. In another exemplary embodiment, seat section 206 can be coupled to back section 212 via a hinge (not illustrated). In this embodiment, both back section 212 and seat section 206 may be directly connected to each other.

Turning back to the exemplary embodiment illustrated in the figure, L-shaped hinge 402 can be coupled to one or more upwardly extending plates 106 on the back of the portion of frame 122. L-shaped hinge 402 in this example can be configured to rotate back section 212 from the bed configuration to the chair configuration. That is, L-shaped hinge 402 can rotate back section 212 about an axis parallel to the transverse and frontal planes. As can be understood from the illustration, the length that upwardly extending plates can extend can be dependent on the thickness of back and seat sections (212 and 206) so that when back section 212 parallel to the transverse plane back section 212 is level with seat section 206. In an exemplary embodiment, back and seat section (212 and 206) can be approximately 4 inches thick. In this exemplary embodiment, upwardly extending plates 106 may extend approximately 2 inches upward.

Continuing with the description of FIG. 4, frame 122 can also include one or more rear-downward angled support members 104. As illustrated in FIG. 4, in an exemplary embodiment, each rear-downward angled support member can be configured such that they intersect a plane parallel to the transverse plane at a 45 degree angle; however, the disclosure is not limited to such a configuration and rear-downward angled support members 104 can be at any angle relative to the transverse plane. Moreover, while two rear-downward angled support members 104 are illustrated, any number of rear-downward angled support members can extend from the flat portion of frame 122. As one skilled in the art can appreciate, frame 112 can be formed to include rear downward angled support members 602 and upwardly extending plates 106; however other embodiments are contemplated. For example, upwardly extending plates 106 could be attached to a frame via one or more bolts or screws, nails, an adhesive, etc., or may be welded to a frame. Moreover, rear-downward angled support members 104 could also be separate components that are attached to a frame via one or more bolts or screws, nails, an adhesive, etc., or may be welded to a frame.

In an exemplary embodiment, rear-downward angled support members 104 can be used to couple a support bar operable to lock back section 212 in one or more positions to frame 122. For example, and illustrated in more detail in FIG.

5, circular holes 402 can be drilled into the distal end of rear-downward angled support members 104. Axles or the like can be used to rotatably couple a support bar, e.g., a square or rectangular shaped bar to frame 122.

Figure 5:
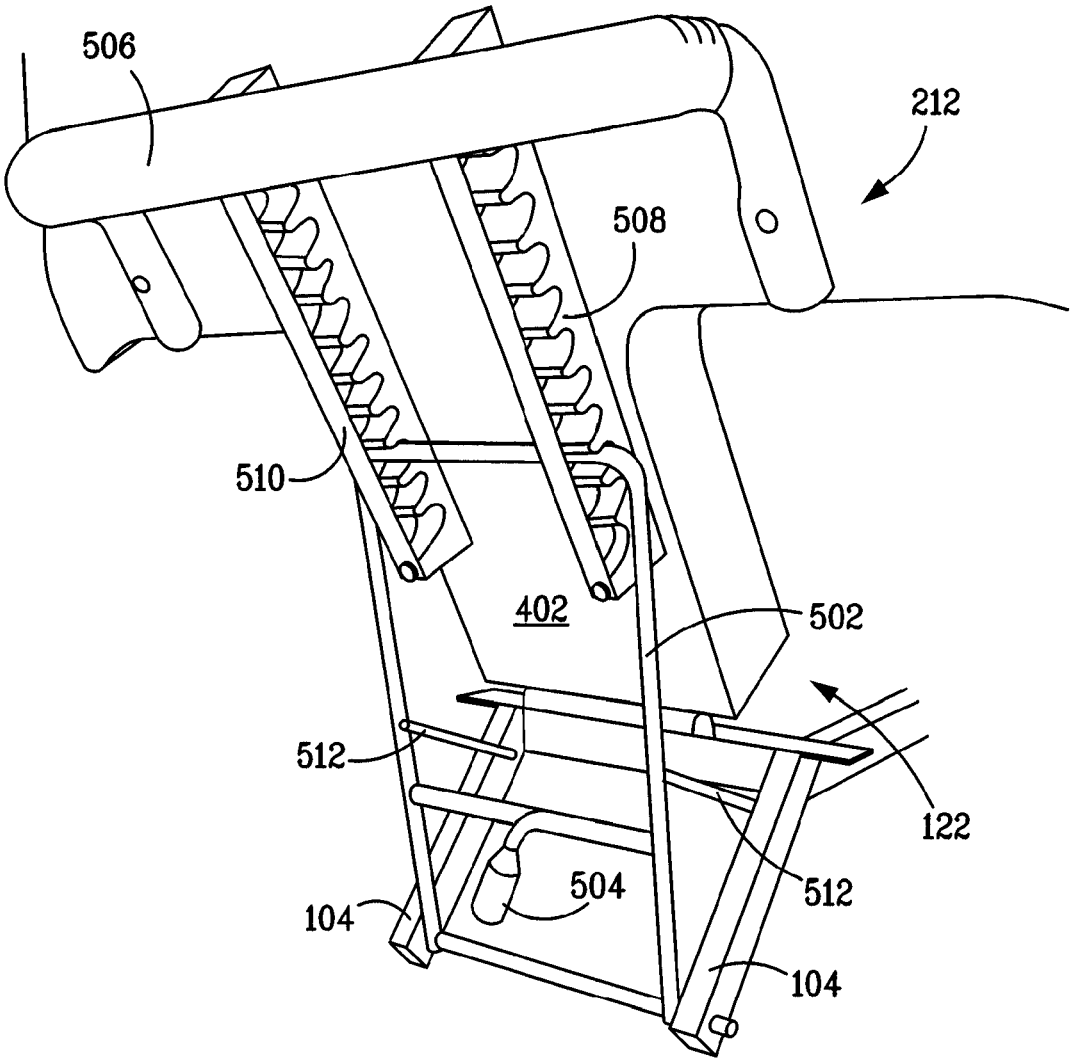
FIG. 5 illustrates a quarter view of a back portion of an exemplary frame of an apparatus.

Turning to FIG. 5, support bar 502 is shown operatively coupled to frame 122 via rear-downward angled support members 104. As shown by the figure, gear rails 508 can be coupled to the back side of back section 212. In an alternative embodiment, gear rails 508 can be coupled to L-shaped hinge 402. A distal end of support bar 502 can be formed to be parallel to the transverse plane and can engage the teeth of gear rails 508. In an example, gear rails 508 can be made of a suitable material such as stainless steel and can have associated catch lock rails 510 attached in order to prevent support bar 502 from disengaging. Tension springs 512, which are designed to absorb and store energy as well as create a force that pulls support bar 502 toward frame 122, can attach frame 122 to support bar 502. In exemplary embodiments, the initial tension force can be set based on the angle rear-downward angled support members 104 form with frame 122, the weight of the support bar 502 and the weight of back section 212, for example. Also shown is a handle 506, which can be used to rotate apparatus about chassis 114.

In operation, a tattoo artist can adjust the angle back section 212 forms with seat section 206 by using the handle 504 to adjust the set of teeth support bar 502 engages. As one of skill in the art can appreciate, in an alternative embodiment, handle 504 can be mounted on the bar portion of bar support 502 to provide a larger torque force when moving the bar from tooth to tooth. When support bar 502 engages the teeth of gear rails 508 closest to the proximal end of the back section 212, back section 212 will be generally perpendicular to the transverse plane. When support bar 502 engages the teeth of gear rails 508 closest to the distal end of the back section 212, back section 212 will be generally flush with seat section 206.

Figure 6:
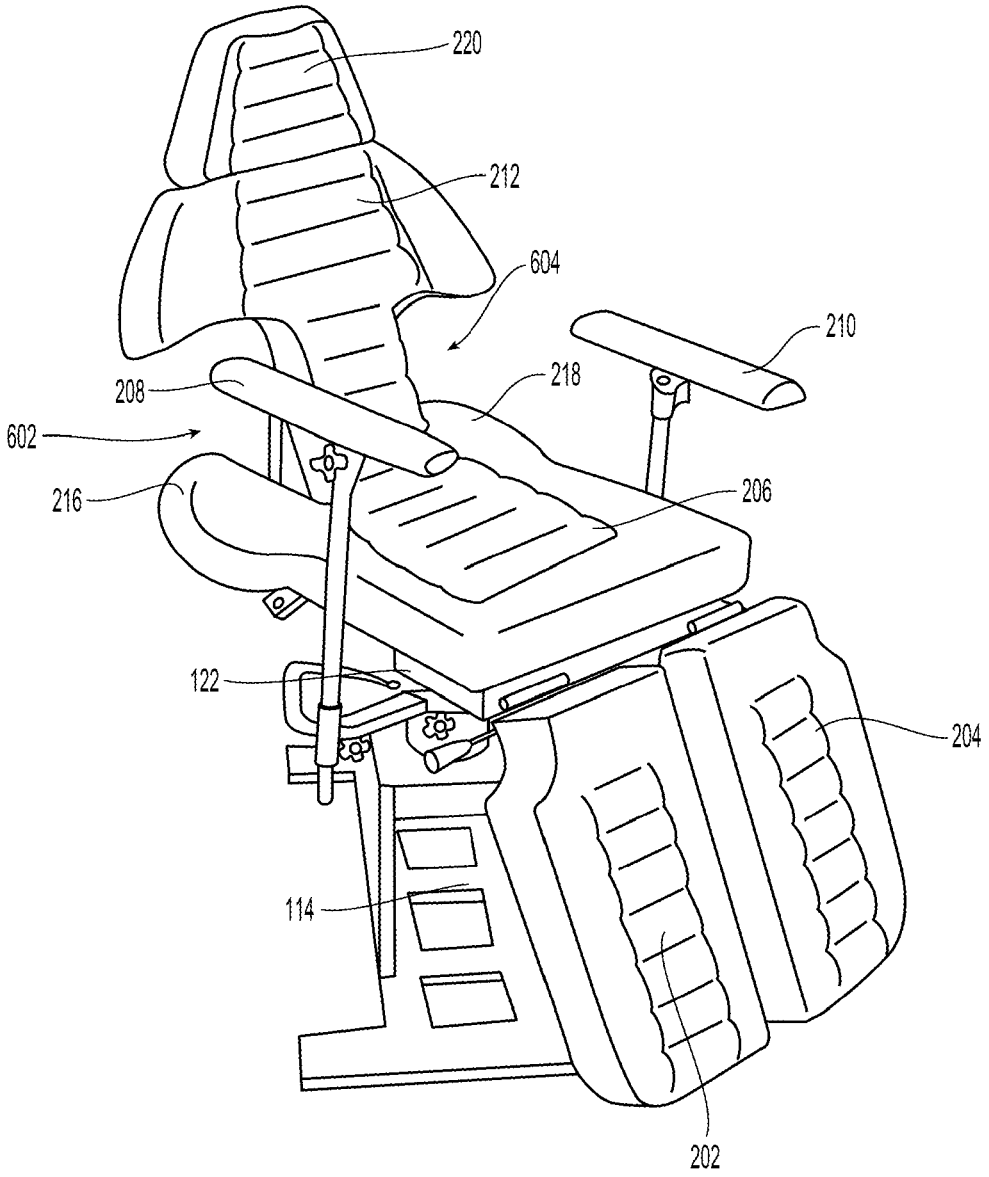
FIG. 6 illustrates a quarter view of an exemplary frame of an apparatus in a chair configuration.

Turning now to FIG. 6, it illustrates the exemplary apparatus in a chair configuration. As shown in the figure, arm sections 208 and 210 are raised up from the position illustrated in FIG. 2 and seat section 206 is rotated a quarter turn counter clockwise about an axis parallel to the midsagittal and frontal planes. In the figure, back section 212 has been rotated about an axis parallel to the transverse and frontal plane approximately 60 degrees upward from a plane that is transverse to apparatus. In this configuration, cuts defining leg openings (602 and 604) are clearly shown. In this configuration, a client could sit rearward with his or her chest resting against back section 212 and insert his or her legs into openings defined by the cuts (602 and 604).

Figure 7:
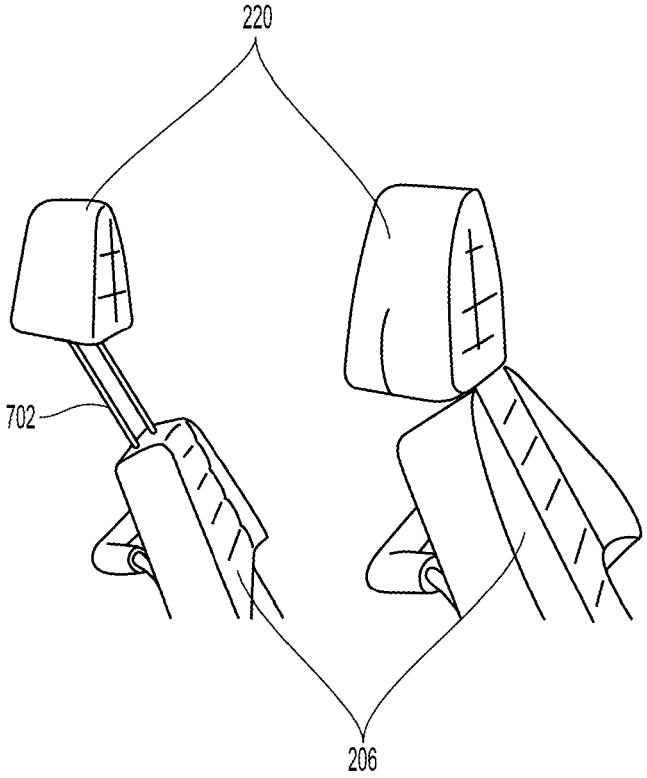
FIG. 7 illustrates a side view of an exemplary back section with a headrest.

FIG. 7 illustrates an exemplary side view of headrest 220 in two positions. As shown by the figure, the position of headrest 220 can be adjusted such that it is extended from back section 206 in order to support a tall client as he or she sits in apparatus. For example, shafts 702 can be attached to headrest 220 and inserted into holes on the top of back section 212. In at least one embodiment, headrest 220 can be removed from back section 212.

Figure 8:
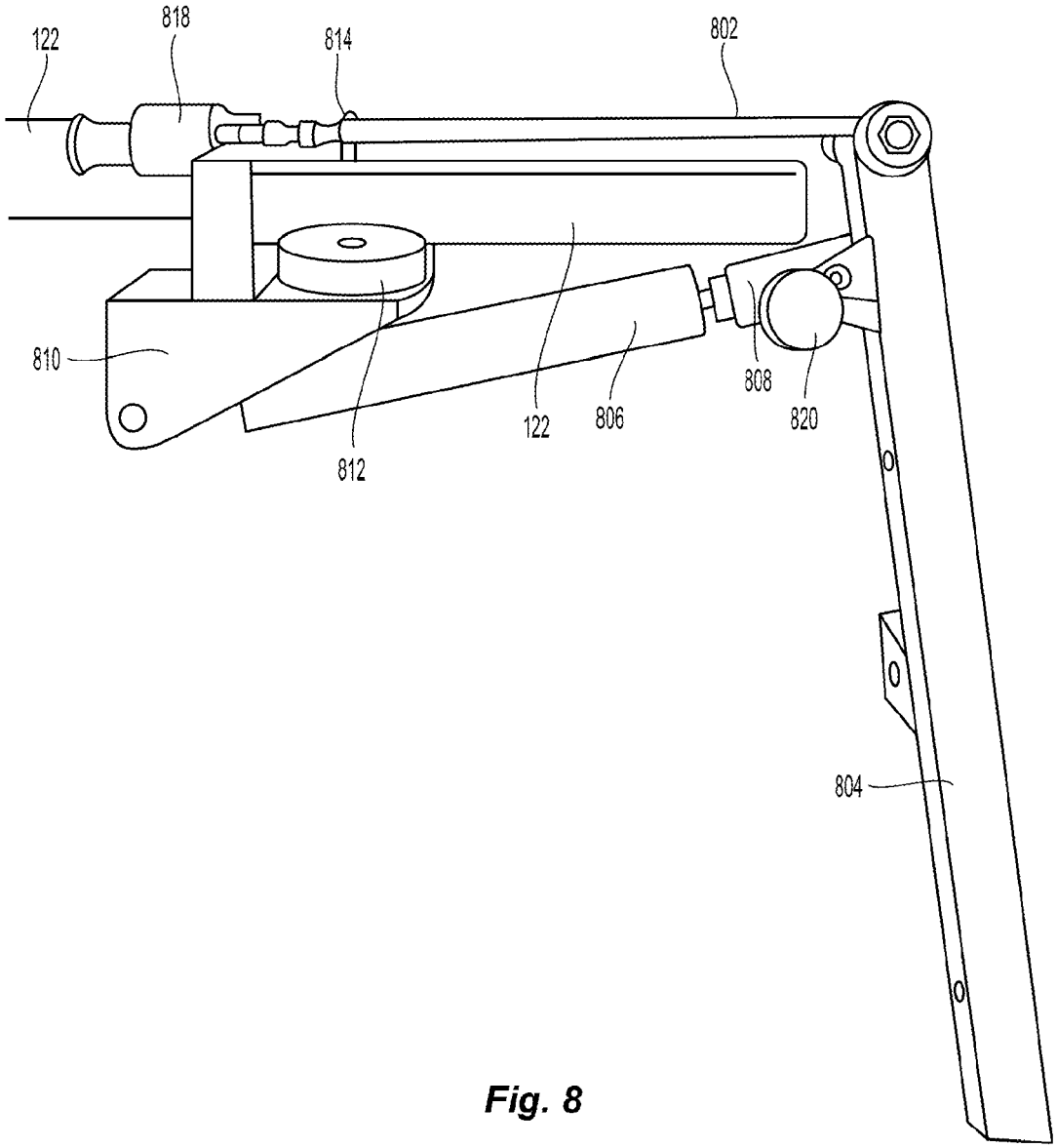
FIG. 8 illustrates a side view of a front portion of an exemplary frame of an apparatus.

FIG. 8 shows an example side view of front portion of frame 122 with an exemplary rotatable assembly that can be used to lift leg section 202. While the following discussion will focus on the left side of the apparatus, one of skill in the art can appreciate that the right side can have similar features. Leg support 202 can be coupled to leg frame 804. Leg frame 804 can be made from any suitable material such as wood or steel. In an exemplary embodiment, leg frame 804 can be rotatably coupled to leg plate 802, which can also be made from any suitable material such as wood or steel. As illustrated more clearly in FIGS. 13 and 14, the proximal end of leg plate 802 can be gear-shaped and held in place by a spring pin assembly 818. The spring pin can be contracted to allow for leg plate 802 to rotate about axle pin 814 in a plane parallel to the transverse plane.

Leg plate 802 can be coupled to the front top portion of frame 122 via axle pin 814 that extends through frame 122 and is coupled to a top portion of circular support 812. As described in more detail in FIGS. 13 and 14, the circular support 812 can rotate about axle 814. The top portion of rear bracket 810 can be attached to the bottom portion of circular member 812. Hydraulic system 806 can be coupled via an axle to the rear portion of rear bracket 810. In this configuration, and described in more detail in FIGS. 13 and 14, when leg plate 802 is rotated in a plane parallel to the transverse plane, axle 814 can rotate rear bracket 810, which in turn rotates hydraulic system 806.

Continuing with the description of FIG. 8, shaft 808 with a bracket attached to the end 808 can be configured to extend from hydraulic system 806 in order to raise leg frame 804 from the position shown in FIG. 8 to the position shown in, for example, FIG. 2. As shown in the figure, the proximal portion of shaft 808 can be operatively coupled to the hydraulic system and the distal end can be rotatably coupled to leg frame 804 via an axle. In an alternative embodiment, hydraulics system can be reversed such that the shaft can engage the rear bracket 810 instead of the leg frame 804. A release lever 820 can be used to configure hydraulics assembly 806 to extend or contract shaft 808.

Figure 9:
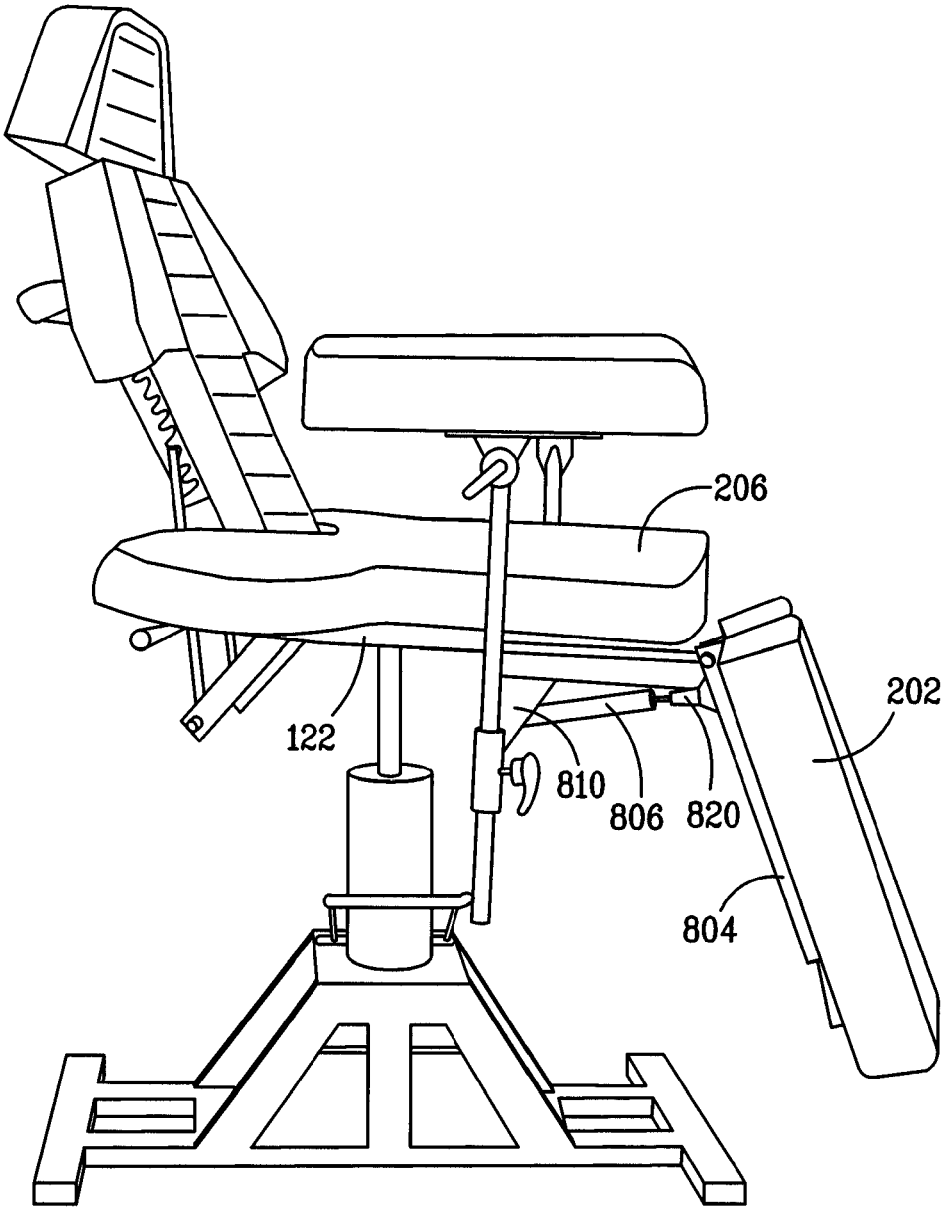
FIG. 9 illustrates a side view of an exemplary frame of an apparatus in a chair configuration.

Turning to FIG. 9, it illustrates a side view of the apparatus in the chair configuration. In the exemplary embodiment, the front portion of frame 122 has an attached rotatable assembly in the same configuration as it is illustrated in FIG. 8. In operation, a tattoo artist can engage release lever 820, which can be used to configure hydraulics assembly 806 to extend or contract shaft 808 that can raise or lower leg frame 804 (thereby raising or lowering leg section 202) from a position generally perpendicular to the transverse plane to a position generally parallel to the transverse plane. When moved into the bed configuration, leg section 202 can be generally flush with seat section 206 (similar to how leg sections 202 and 204 are illustrated in FIG. 2).

Figure 10:
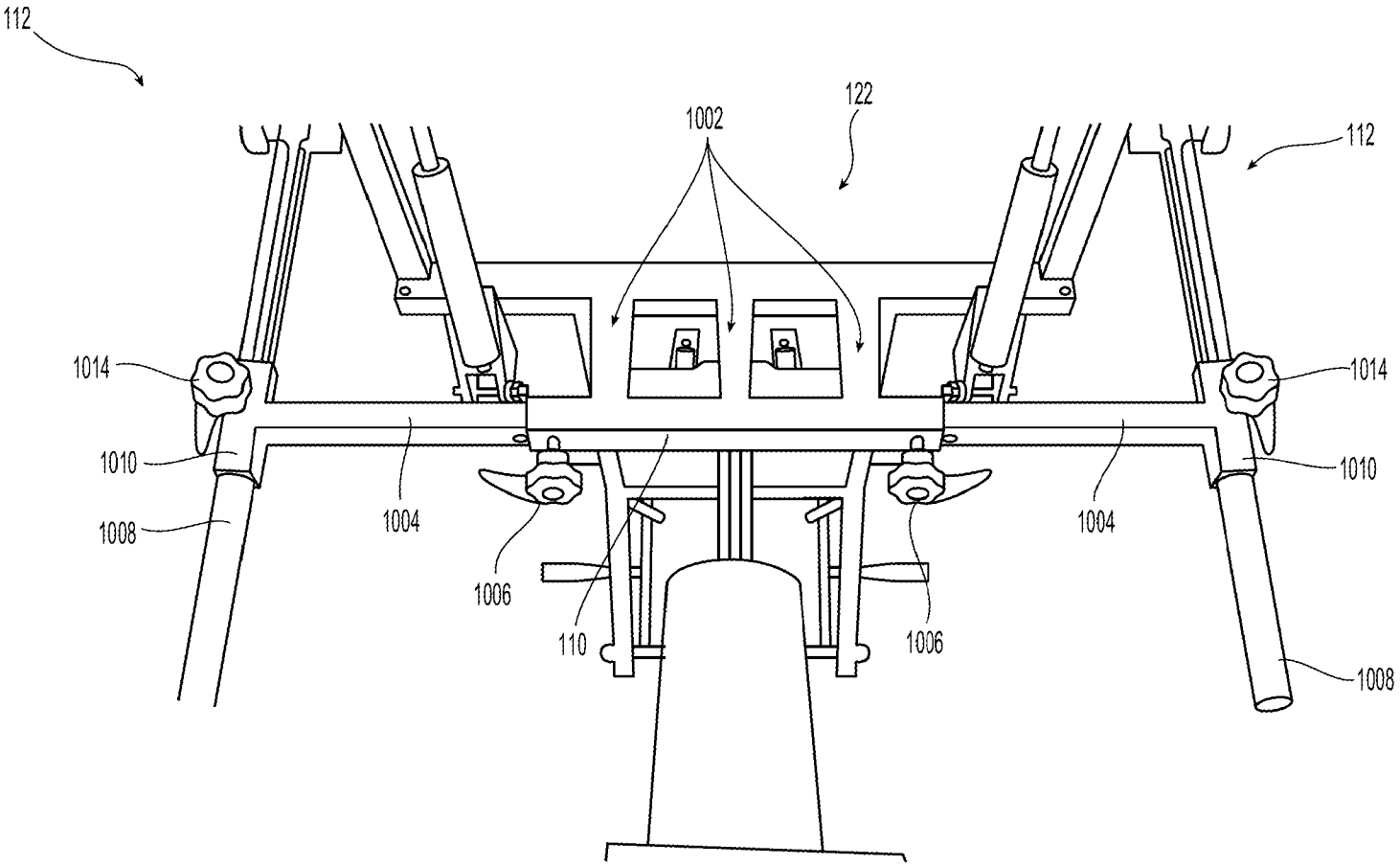
FIG. 10 illustrates a view of underneath the front portion of an exemplary frame of an apparatus.

Turning to FIG. 10, it is a view from the underside of the front portion of frame 122 illustrating how exemplary arm assemblies 112 can be coupled to frame 122 in an exemplary embodiment. In this embodiment, the bottom of the frame 122 can include one or more downward extending members 1002 coupled to a horizontal tubular rail 110. On each end of the horizontal tubular rail 110, openings can receive the proximal ends of two shafts 1004 that are part of the arm assemblies 112. In the illustrated example, the tubular rail can be mounted such that the two shafts 1004 can be independently extended in a direction away from the midsagittal plane of the apparatus. That is, the two shafts 1004 can be linearly extended and contracted in the transverse plane. The two shafts 1004 can include vertically extending holes that can be used to secure arm bar assemblies to frame 122. In an exemplary embodiment, screw clamps 1006 can be used to secure the position of shafts 1004 and in at least one embodiment, shafts 1004 can be detached completely. In an exemplary embodiment, horizontal tubular rail 110 can be cylindrical and the horizontal shafts can be rotated within the tubular rail in order to adjust the position of the arm assemblies 112. In this example, shafts 1004 can include a plurality of holes separated from each other not only horizontally, but also around the housing of the cylindrical horizontal shafts. In this configuration, screw claims 1006 could be used to secure arm bar assemblies from rotating about an axis parallel to the frontal and transverse planes and linearly moving in the transverse plane. For example, in this configuration arm assemblies 112 could be independently rotated 360 degrees within the tubular rail through a plane parallel to the transverse plane of the apparatus.

Continuing with the description of FIG. 10, the distal ends of the horizontal shafts 1004 can include support plates 1010 coupled to vertical shafts 1008 via an axle attached to tension levers 1014, which can be used to lock the vertical shafts 1008 in position. The tension levers 1014 can be used to release the pressure holding vertical shafts 1008 such that the vertical shafts 1008 can be moved in a linear vertical direction perpendicular to the transverse plane of the apparatus. That is, arm assemblies 112 can be raised or lowered by adjusting the position of the vertical shafts 1008.

Figure 11:
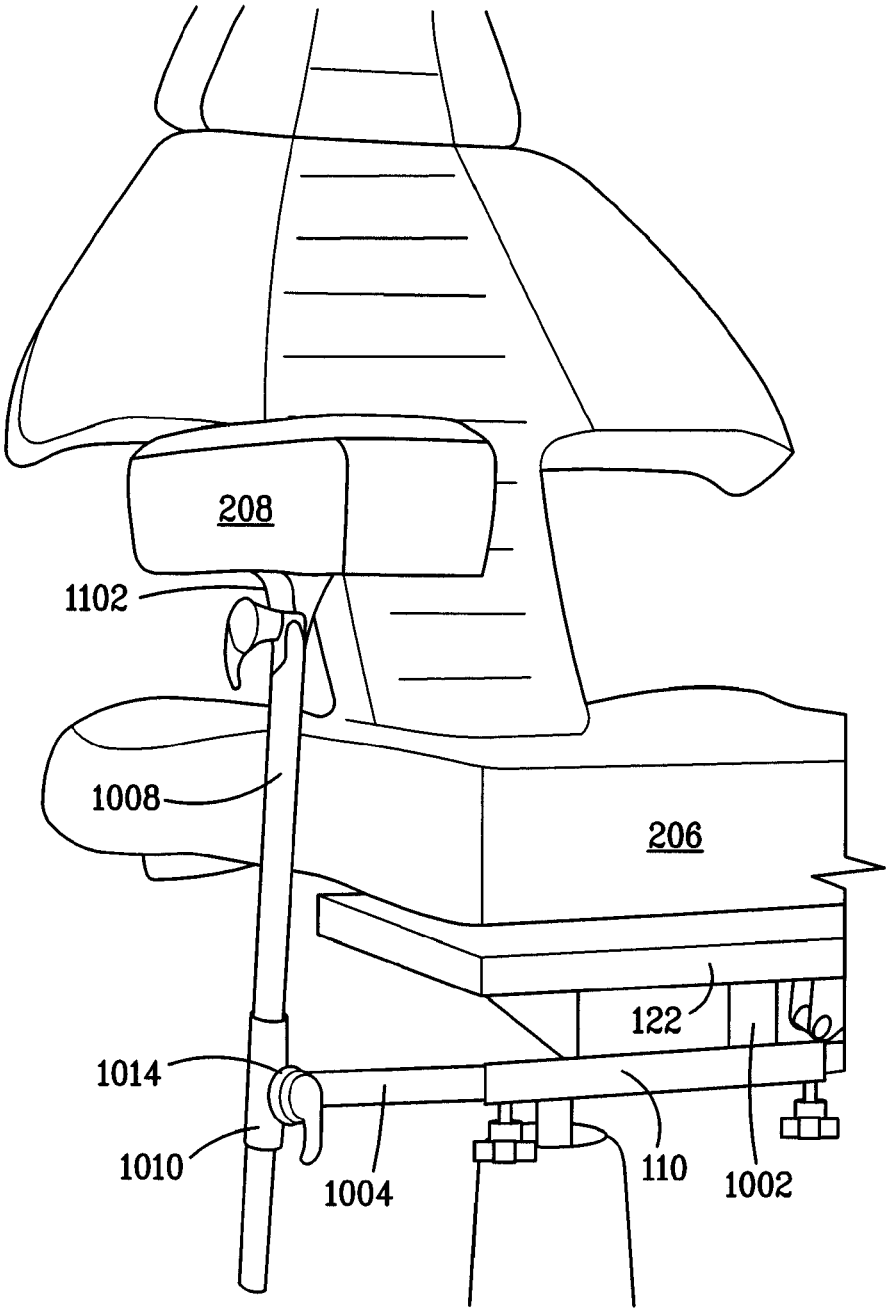
FIG. 11 illustrates a quarter view of an exemplary apparatus in a chair configuration.

Turning now to FIG. 11, it illustrates the left side of the apparatus with the legs removed in order to illustrate the left arm assembly. As shown by the figure, arm section 206 can be coupled to vertical shaft 1008 via bracket 1102. In an exemplary embodiment, bracket 1102 can be configured to rotate arm section 206 through a plane parallel to the transverse plane. In an exemplary embodiment, bracket 1102 can be configured to rotate from a position generally parallel with a plane parallel to the transverse plane of the apparatus 45 degrees clockwise or counterclockwise. Or put another way, bracket 1102 can rotate about an axis parallel to the transverse and frontal planes. In this embodiment, a hole can be drilled through shaft 1008 and an axle bolt can couple bracket 1102 to shaft 1008. The position of arm section 206 can be secured by a tension lever coupled to a plate via an axle bolt. When the lever is opened, the pressure on bracket 1102 can be released so arm section 206 can be moved.

Figure 12:
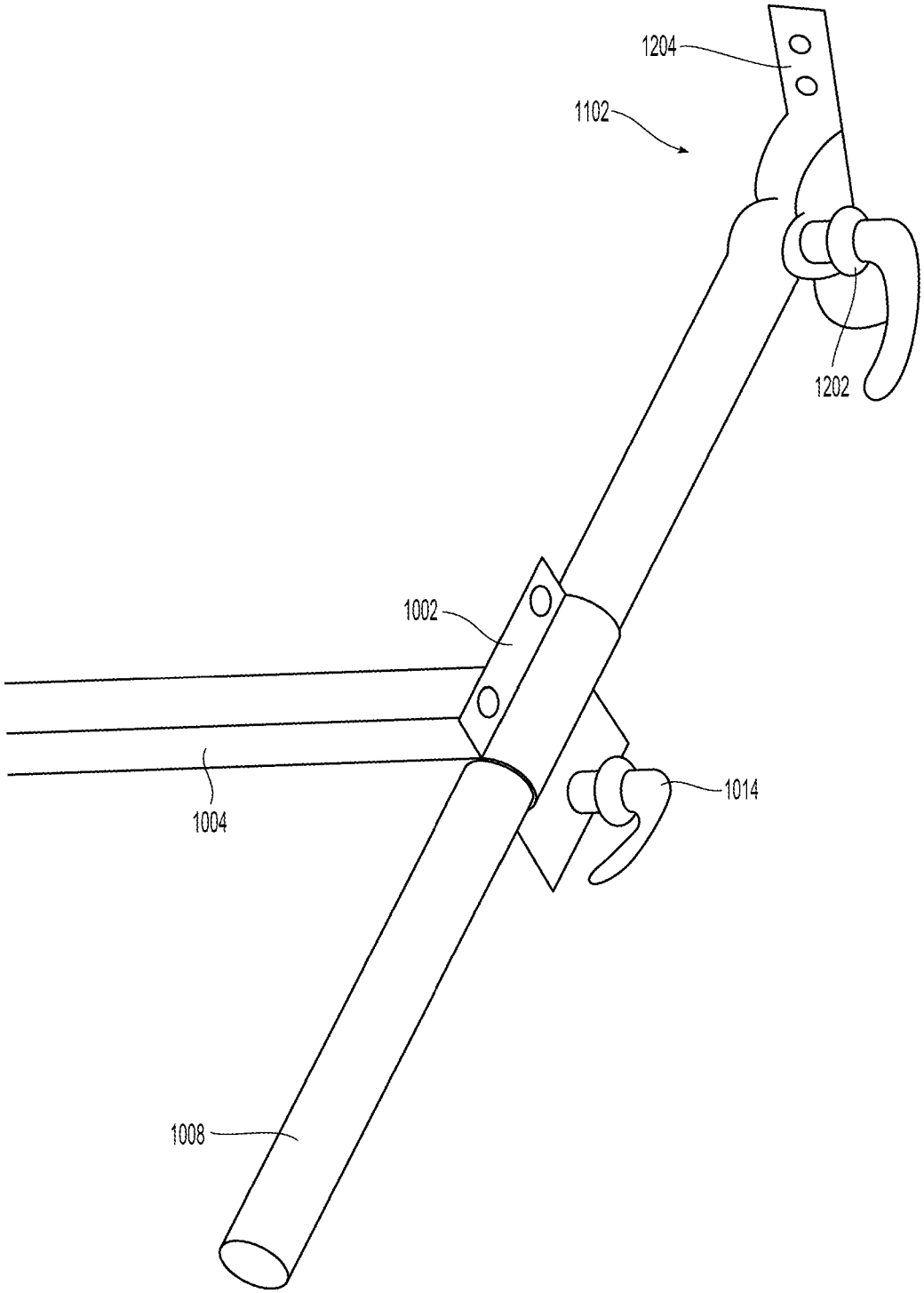
FIG. 12 illustrates an exemplary arm assembly.

An exploded view of an exemplary arm assembly is shown in FIG. 12. In this embodiment, shaft 1008 is shown coupled to horizontal shaft 1004 via support plates 1010. One support plate 1010 can be fixed to the distal end of the horizontal shaft 1004 and the other can be secured to it by bolts and tension applied by tension lever 1014. In this example, the plates can be curved so as to define a tube for vertical shaft 1008 to be inserted. The vertical position of vertical shaft 1008 can be adjusted and the tension lever 1014 can be used to lock the vertical shaft in position. In addition, when vertical shaft 1008 is generally circular, vertical shaft 1008 can be rotated about an axis passing through the middle of vertical shaft 1008. In this example, arm section 208 can be rotated 360 degrees in the tube defined by plates 1010.

Bracket 1102 can be coupled to one end of vertical shaft 1008 via an axle bolt and a tension lever 1202. In this example, the distal end of the bracket 1102 can include a plate 1204 configured to secure arm section 208. For example, arm section 208 could be coupled to the distal plate 1204 via a bolt. The proximal end of bracket 1102 can be curved to allow for rotational motion about the axle pin securing it to vertical shaft 1008. In operation, a tattoo artist could release tension lever 1202 thereby allowing bracket 1102 to rotate; position the bracket; and use the tension lever 1202 to lock bracket 1102 into position.

Referring now to FIG. 13, illustrated is an alternative configuration for back section 212. This exemplary configuration can be used when back section 212 is configured to rotate from a chair configuration to a position substantially 30 degrees from the transverse plane. Thus, back section 212 may not fully recline into the bed configuration in this embodiment. As illustrated by FIG. 13, in this exemplary embodiment, arm frame sections 1302 and 1304 can be rotatably coupled to back section 212. Arm sections similar to arm sections 208 and 210 can be attached to arm frame sections 1302 and 1304. However, in this example, the arm sections can encircle the arm frame sections 1302 and 1304 and can include cushioning for both a top side and a bottom side. As shown by the figure, arm frame sections 1302 and 1304 can be independently rotated from a first position whereby arm frame sections 1302 and 1304 can be used as supports for a person sitting with his or her back against back section 212 clockwise 180 degrees about an axis parallel to both the frontal plane and transverse plane to a second position whereby the arm sections 1302 and 1304 can be used as supports for a person straddling back section 212.

Turning to FIG. 14, illustrated are exemplary components for attaching arm frame support 1302 to back section 212. For example, support plate 1402 can be secured to back section 212 via one or more screws. Circular shaft 1404 can be operatively attached to support plate 1402, e.g. it could be welded to support plate 1402. In this example the proximal portion of arm frame support can be operatively coupled, e.g., welded, to a cylindrical tube 1406. The cylindrical tube 1406 can be inserted into circular shaft 1404.

Figure 15:
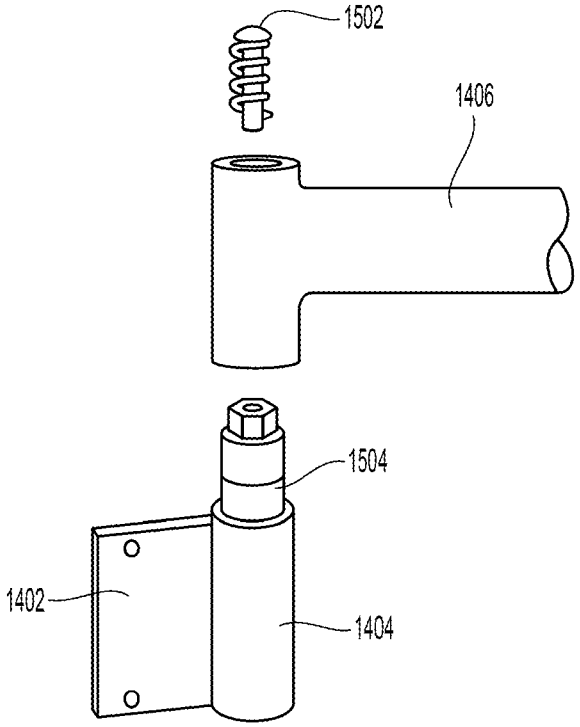
FIG. 15 illustrates exemplary components for rotatably coupling an arm frame support to an exemplary back section of an apparatus.

Referring to FIG. 15, shown is cylindrical tube 1406 detached from circular shaft 1404. In the illustrated embodiment, the male connection of circular shaft can include hexagon shaped rotating member 1504. The end that is visible in FIG. 15 can mate with a female end within cylindrical tube 1406. Hexagon shaped rotating end 1504 can be threaded to receive screw 1502 to secure cylindrical tube 1406 to circular shaft 1404. The other portion of hexagon shaped rotating member 1504 can extend within circular shaft 1404 and have a tooth that engages with a housing within circular shaft 1404 that prevents hexagon shaped rotating end 1504 from rotating more than 180 degrees.

Figure 16:
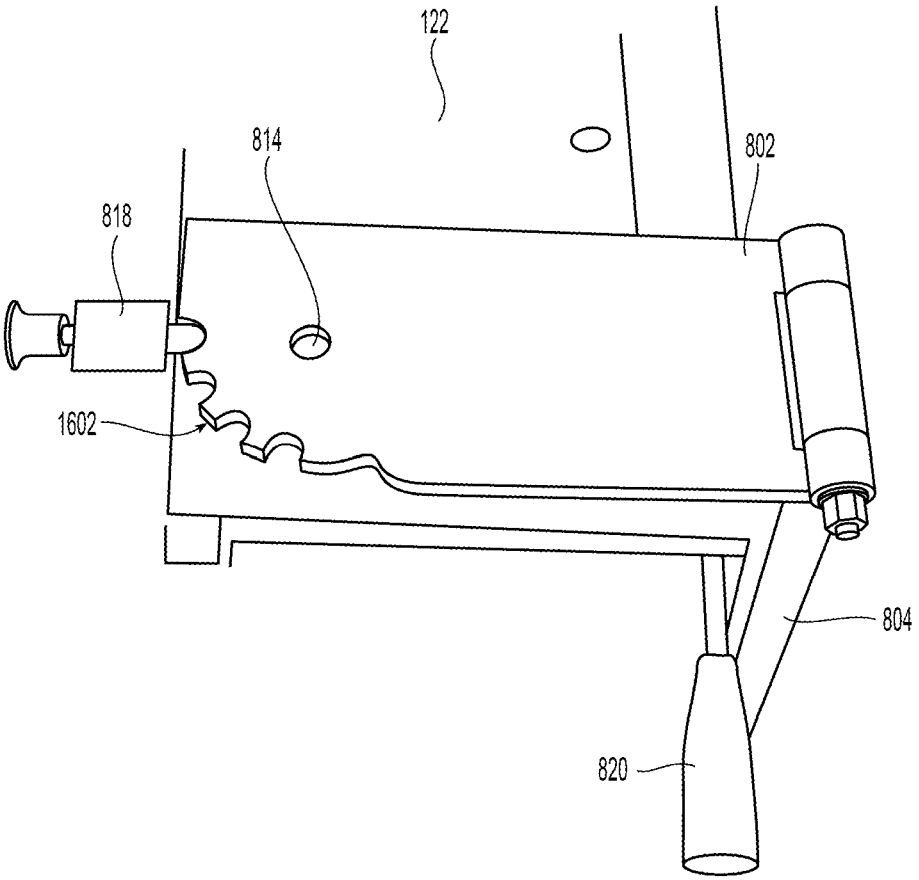
FIG. 16 illustrates an over-the-head view of a front of an exemplary frame of an apparatus.

Turning now to FIG. 16, illustrated is a top view of the left front portion of frame 122 and an exemplary rotatable assembly. In an embodiment, frame 122 can have a "T" shaped front portion configured to support leg plate 802. The proximal end of leg plate 802 is shown to include a gear-like end that includes one or more gear teeth 1602. Spring pin assembly 818 can be configured to position a pin such that it engages a space in between two teeth herein referred to as a groove. In this exemplary configuration, the pin can be used to secure the position of leg plate 802 such that it will prevent leg plate 802 from rotating. In the instance where a tattoo artist wants to adjust the position of the leg sections in order to, for example, tattoo a client's inner thigh, the tattoo artist can pull on a handle attached to the distal end of spring pin assembly 818 to disengage the pin from a groove and pull on lever arm 820 to rotate leg frame 804 from the position illustrated in FIG. 13 to the position illustrated in FIG. 14. The tattoo artist can release the handle of the spring pin assembly 818 and the spring can force the pin to engage a groove thereby locking leg frame 804 into position. In an exemplary embodiment, the gear-like portion of leg plate 802 can include, for example, 5 teeth spaced such that each groove can lock leg frame 804 in increments of 20 degrees about an axis parallel to the frontal and midsagittal planes. In an exemplary embodiment, each groove can be used to lock leg frame 804 at 15, 35, 55, 75, and 90 degrees from the midsagittal plane of the apparatus. One skilled in the art can appreciate that the number of teeth and the spacing of them is variable and that while one embodiment is illustrated it is contemplated that any number of teeth and any spacing can be used.

Figure 17:
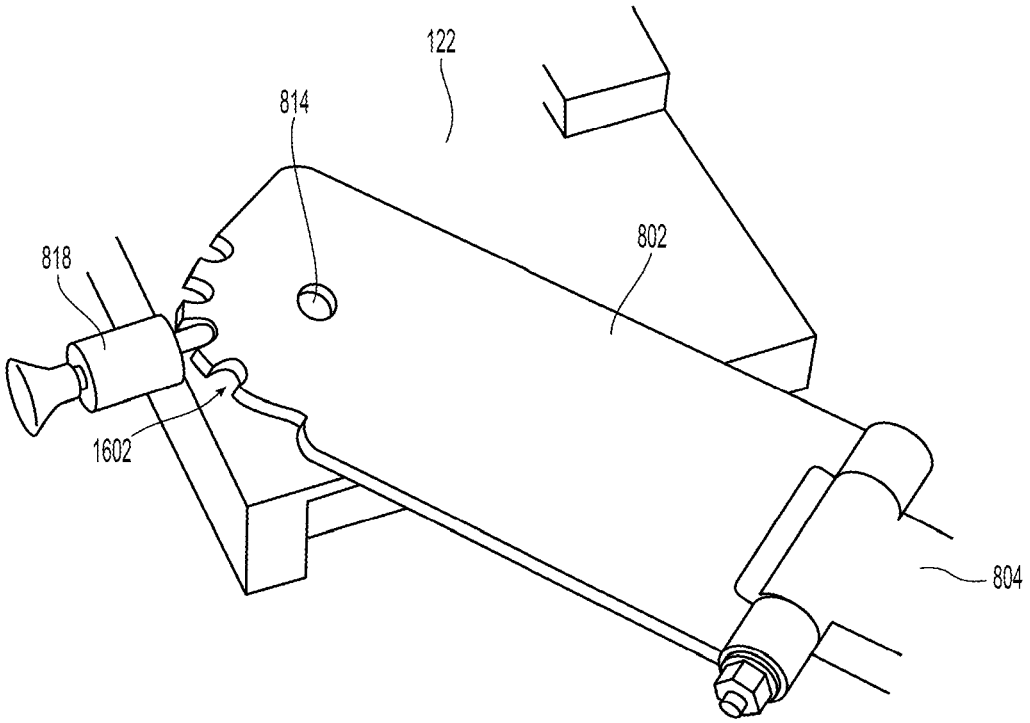
FIG. 17 illustrates an over-the-head view of a front of an exemplary frame of an apparatus.

Turning now to FIG. 17, illustrated is the exemplary apparatus in the chair configuration with the exemplary rotatable assembly configured such that the left leg is about 75 degrees from the midsagittal plane.

Figure 18:
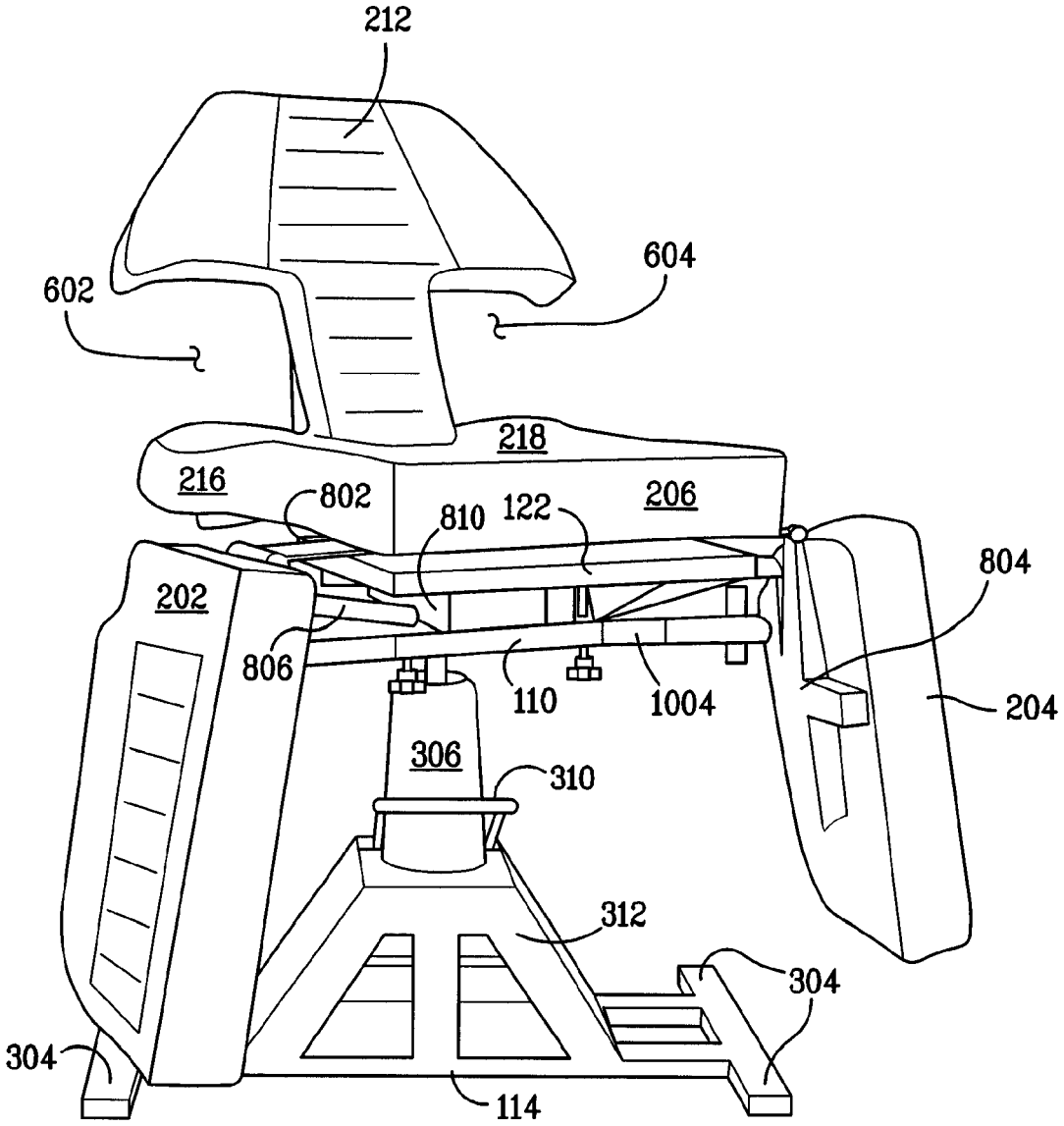
FIG. 18 illustrates a quarter view of an exemplary apparatus in a chair configuration with leg supports rotated about a vertical plane.

FIG. 18 shows the exemplary apparatus in the chair configuration with leg sections 202 and 204 rotated into a position whereby they are generally perpendicular to the midsagittal plane. In this example, vertical shafts 1008 and arm sections 208 and 210 have been removed. This exemplarily embodiment can be used to tattoo the lower back portion of a client. For example, the client can straddle back section 212 by placing his or her legs through the cuts that define leg openings 602 and 604. The tattoo artist can use hydraulics system 306 to raise or lower the position of seat section 206 to place the client's lower back in a position where it is comfortable for the tattoo artist to work and comfortable for the client. In this exemplary embodiment, client can lean forward and rest his or her chest on the padded top portion of back section 212. This action causes the skin of the client's back to naturally stretch thereby aiding the tattoo artist in the application of a tattoo. The tattoo artist can also rotate the apparatus into the illustrated position in order to move his or her chair closer to the client. That is, the tattoo artist can roll a chair in between stabilizer plate sections 304.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein.

What is claimed is:

1. An apparatus for positioning a subject during tattooing, the apparatus comprising:

a seat section with a front section;

a first rotatable leg assembly configured to support a first leg of the subject sitting on the seat section, wherein the first rotatable leg assembly is rotatable about a substantially horizontal first axis of rotation and a substantially vertical second axis of rotation;

a second rotatable leg assembly configured to support a second leg of the subject sitting on the seat section, wherein the second rotatable leg assembly is rotatable about a substantially horizontal third axis of rotation and a substantially vertical fourth axis of rotation;

a back section movable relative to the seat section to move the apparatus between a bed configuration and a chair configuration;

a first arm section configured to support a first arm of the subject, wherein the first arm section is rotatable relative to the back section; and a second arm section configured to support a second arm of the subject, wherein the second arm section is rotatable relative to the back section, wherein the first rotatable leg assembly, the second rotatable leg assembly, the first arm section, and the second arm section are independently rotatable relative to one another when the apparatus is in the bed configuration and when the apparatus is in the chair configuration, and wherein the first and second rotatable leg assemblies are rotatable about the vertical second and fourth axes of rotation, respectively, such that entire leg support surfaces of the first and second rotatable leg assemblies move rearwardly past the front section when the first and second rotatable leg assemblies, which are in lowered positions, move away from a forward position to a rearward position.

2. The apparatus of claim 1, wherein the first rotatable leg assembly and the second rotatable leg assembly are movable away from each other such that the first rotatable leg assembly and the second rotatable leg assembly are positioned on opposite sides of the seat section.

3. The apparatus of claim 1, wherein the second and fourth axes of rotation extend through the seat section.

4. The apparatus of claim 1, wherein the back section has a first leg opening, a second leg opening, and an elongated portion positioned between the first and second leg openings such that the subject's legs are capable of being positioned in the first and second leg openings when the subject straddles the elongated portion while the apparatus is in the chair configuration.

5. An apparatus for positioning a subject during tattooing, the apparatus comprising:

a seat section;

a first rotatable leg assembly configured to support a first leg of the subject sitting on the seat section, wherein the first rotatable leg assembly is rotatable about a substantially horizontal first axis of rotation and a substantially vertical second axis of rotation;

a second rotatable leg assembly configured to support a second leg of the subject sitting on the seat section, wherein the second rotatable leg assembly is rotatable about a substantially horizontal third axis of rotation and a substantially vertical fourth axis of rotation;

a back section movable relative to the seat section to move the apparatus between a bed configuration and a chair configuration, wherein the back section has a first leg opening, a second leg opening, and an elongated portion positioned between the first and second leg openings such that the subject's legs are capable of being positioned in the first and second leg openings when the subject straddles the elongated portion while the apparatus is in the chair configuration;

a first arm section configured to support a first arm of the subject, wherein the first arm section is rotatable relative to the back section; and a second arm section configured to support a second arm of the subject, wherein the second arm section is rotatable relative to the back section, wherein the first rotatable leg assembly, the second rotatable leg assembly, the first arm section, and the second arm section are independently rotatable relative to one another when the apparatus is in the bed configuration and when the apparatus is in the chair configuration, wherein the seat section includes a first rear portion and a second rear portion, wherein the elongated portion is positioned between the first and second rear portions of the seat section such that the first and second rear portions of the seat section extend into the first and second leg openings when the apparatus is in the bed configuration.

6. The apparatus of claim 5, wherein the back section includes a first lateral back portion defining the first leg opening and a second lateral back portion defining the second leg opening, and wherein the first lateral back portion is positioned above the first rear portion of the seat section and the second lateral back portion is positioned above the second rear portion of the seat section when the apparatus is in the chair configuration.

7. The apparatus of claim 1, wherein each of the first and second arm sections is linearly repositionable in a direction perpendicular to a midsagittal plane of the apparatus and vertically repositionable in a direction perpendicular to a horizontal transverse plane of the apparatus while the apparatus is in the chair configuration.

8. The apparatus of claim 1, further comprising a hydraulic system operable to rotate the first rotatable leg assembly, in a first lowered position, about the first axis of rotation towards a first horizontal orientation, and wherein the hydraulic system is operable to rotate the second rotatable leg assembly, in a second lowered position, about the third axis of rotation towards a second horizontal orientation.

9. An apparatus for positioning a subject during tattooing, comprising:

a back section including a first lateral back portion, a second lateral back portion, and a central back region, wherein the first lateral back portion and the central back region define a first leg opening, wherein the second lateral back portion and the central back region define a second leg opening, and wherein the central back region is positioned between the first and second leg openings;

a seat section including a first lateral seat portion, a second lateral seat portion, and a central seat region, wherein the first lateral seat portion and the second lateral seat portion extend alongside the central back region and into the first and second leg openings, respectively, when the apparatus is in a bed configuration, and wherein the central back region is rotatably coupled to the central seat region such that the first lateral back portion moves to be positioned above the first lateral seat portion and the second lateral back portion moves to be positioned above the second lateral seat portion when the apparatus moves from the bed configuration to a chair configuration;

a first rotatable leg assembly configured to support a first leg of the subject sitting on the seat section; and a second rotatable leg assembly configured to support a second leg of the subject sitting on the seat section.

10. The apparatus of claim 9, wherein the first lateral seat portion extends underneath the first lateral back portion and the second lateral seat portion extends underneath the second lateral back portion when the apparatus is in the chair configuration.

11. The apparatus of claim 9, further comprising a headrest positionable to support a head of the subject when the subject lies on the apparatus in the bed configuration, and wherein the headrest is configured to be separated from the back section when the apparatus is in the chair configuration.

12. The apparatus of claim 9, further comprising:

a first arm section configured to support a first arm of the subject, wherein the first arm section is rotatably coupled to the back section; and a second arm section configured to support a second arm of the subject, wherein the second arm section is rotatably coupled to the back section, wherein the first rotatable leg assembly, the second rotatable leg assembly, the first arm section, and the second arm section are independently rotatable relative to one another.

13. The apparatus of claim 12, wherein the back section, the seat section, the first rotatable leg assembly, the second rotatable leg assembly, the first arm section, and the second arm section are in a generally planar configuration when the apparatus is in the bed configuration.

14. The apparatus of claim 12, wherein the back section, the seat section, the first rotatable leg assembly, the second rotatable leg assembly, the first arm section, and the second arm section are movable relative to one another to reconfigure the apparatus from the bed configuration to the chair configuration.

15. The apparatus of claim 9, wherein the first rotatable leg assembly is movable away from a midsagittal plane of the apparatus to a first lateral position, wherein the second rotatable leg assembly is movable away from the midsagittal plane to a second lateral position, and wherein the seat section is positioned between the first and second rotatable leg assemblies in the first and second lateral positions.

16. An apparatus for supporting a subject during tattooing, comprising:

a seat section;

a back section movable relative to the seat section to move the apparatus between a chair configuration and a bed configuration;

a first rotatable leg assembly configured to rotate a first leg section about a first axis and a second axis, wherein the first axis is generally parallel to a horizontal transverse plane of the apparatus, and wherein the second axis is generally perpendicular to the transverse plane of the apparatus; and a second rotatable leg assembly configured to rotate a second leg section about a third axis and a fourth axis, wherein the third axis is generally parallel to the transverse plane and the fourth axis is generally perpendicular to the transverse plane of the apparatus, and wherein the first and second rotatable leg assemblies are independently rotatable about the second axis and the fourth axis, respectively, wherein the second and fourth axes extend though the seat section such that the first and second leg sections are rotatable rearwardly past a front section of the seat section.

17. The apparatus of claim 16, wherein the first rotatable leg assembly is configured to rotate the first leg section up to a point where the first leg section is generally parallel to the transverse plane and the second rotatable leg assembly is configured to rotate the second leg section up to a point where the second leg section is generally parallel to the transverse plane.

18. The apparatus of claim 16, wherein the seat section has a rear portion adjacent to the back section.

19. The apparatus of claim 16, wherein the first leg section is rotatable about the second axis up to about 90 degrees.

20. The apparatus of claim 16, wherein the first rotatable leg assembly in a lowered position is rotatable rearwardly so that substantially all of the first leg section is located rearward of the front section of the seat section.

21. The apparatus of claim 16, wherein the first rotatable leg assembly has a fully raised position and a fully lowered position, wherein the first leg section is at the same height as the seat section such that the subject's legs and torso lay flat when the first rotatable leg assembly is in the fully raised position, and wherein the first leg section is positioned lower than the seat section when the first rotatable leg assembly is in the fully lowered position.

22. The apparatus of claim 21, wherein each of the first and second rotatable leg assemblies is rotatable about the second and fourth axes, respectively, up to about 90 degrees, and wherein a front section of the seat section is positioned higher than and extends forwardly past the first and second rotatable leg assemblies when the first and second rotatable leg assemblies are located at the sides of the seat section.

23. An apparatus for positioning a subject during tattooing, the apparatus comprising:

a seat section including a first rear portion and a second rear portion;

a first rotatable leg assembly configured to support a first leg of the subject sitting on the seat section, wherein the first rotatable leg assembly is rotatable about a substantially horizontal first axis of rotation and a substantially vertical second axis of rotation;

a second rotatable leg assembly configured to support a second leg of the subject sitting on the seat section, wherein the second rotatable leg assembly is rotatable about a substantially horizontal third axis of rotation and a substantially vertical fourth axis of rotation; and a back section movable relative to the seat section to move the apparatus between a bed configuration and a chair configuration, wherein the back section has a first leg opening, a second leg opening, and an elongated portion positioned between the first and second leg openings such that the subject's legs are capable of being positioned in the first and second leg openings when the subject straddles the elongated portion while the apparatus is in the chair configuration, and wherein the elongated portion is positioned between the first and second rear portions of the seat section such that the first and second rear portions of the seat section extend into the first and second leg openings when the apparatus is in the bed configuration.

* * * * *